United States Patent [19]

Lyndhurst

[11] 4,382,427

[45] May 10, 1983

[54] RECIPROCATING ENGINE COOLING SYSTEM

[75] Inventor: Francis R. Lyndhurst, Costa Mesa, Calif.

[73] Assignee: Aero Power Engine Manufacturing, Inc., Incline Village, Nev.

[21] Appl. No.: 307,744

[22] Filed: Oct. 2, 1981

[51] Int. Cl.[3] ..... F01P 3/02

[52] U.S. Cl. ..... 123/41.74; 123/41.79

[58] Field of Search ..... 123/41.29, 41.44, 41.74, 123/41.79

[56] References Cited

U.S. PATENT DOCUMENTS

| | | | |
|---|---|---|---|
| 2,334,731 | 11/1943 | Szekely | 123/41.29 |
| 2,713,332 | 7/1955 | Beardsley | 123/41.44 |
| 4,212,281 | 7/1980 | Ernest | 123/41.79 |

*Primary Examiner*—William A. Cuchlinski, Jr.
*Attorney, Agent, or Firm*—William W. Haefliger

[57] ABSTRACT

An internal combustion engine has air/fuel intake manifolding and porting proximate the head of the engine, and exhaust manifolding and porting proximate the head of the engine, the engine including:

(a) a cylinder block having two longitudinal rows of cylinders with V-shaped configuration, (b) the block forming coolant passages proximate the cylinders, there being multiple coolant inlets at one side of each of the rows to flow coolant to the passages at said one side of each of the rows and also to flow coolant around opposite ends of each row to the passages at the other side of the row, (c) and a cylinder head for each of the rows of cylinders, each head having first and second coolant passages respectively in communication with the passages in the block at the one and the other side of each such row of cylinders to receive coolant flow therefrom, the second passages in the head extending proximate the air/fuel intake porting, the first passages in the head extending proximate the exhaust porting, said intake manifolding everywhere isolated from the first passages in the head.

9 Claims, 15 Drawing Figures

RECIPROCATING ENGINE COOLING SYSTEM

BACKGROUND OF THE INVENTION

This invention relates generally to internal combustion engines of reciprocating type, and more particularly concerns on improved cooling system for such an engine, typically of light weight metal construction.

There is need for high performance engines of the above type, wherein the delivered horsepower to weight ratio is unusually high. Aircraft engines are one example, and consequent savings in fuel consumption are highly desirable. In order to achieve these ends, it is desirable to provide for maximum cooling and cooling efficiency, without causing the heated coolant to transfer heat to the incoming air/fuel mixture, which would otherwise tend to decrease the density of that mixture and reduce engine performance. This presents a number of problems in V-shaped engine blocks, due to space limitations and other factors.

SUMMARY OF THE INVENTION

It is a major object of the invention to provide solutions to the above problems, as well as additional improvements and unusual structural advantages, as will appear. Basically, the invention is embodied in an engine having air/fuel intake manifolding and porting proximate the head or heads of the engine as well as exhaust manifolding and porting adjacent the head or heads, the improvement combination comprising (a) a cylinder block having two longitudinal rows of cylinders with V-shaped configuration, (b) the block forming coolant passages proximate the cylinders, there being multiple coolant inlets at one side of each of said rows to flow coolant to said passages at said one side of each of said rows and also to flow coolant around opposite ends of each row to the passages at the other side of said row, (c) and a cylinder head for each of said rows of cylinders, each head having first and second coolant passages respectively in communication with said passages in the block at said one and said other side of each said row of cylinders to receive coolant flow therefrom, said second passages in the head extending proximate the air/fuel intake porting, said first passages in the head extending proximate the exhaust porting, said intake manifolding everywhere isolated from said first passages in the head.

Typically, there are three of the coolant inlets to each block, the inlets located proximate outer sides of the block, two of the inlets located proximate opposite ends of the block to flow unheated coolant around opposite ends of the cylinder row to access the passages at the inner or rear side of the cylinder row, and the third inlet located mid-way between those opposite ends to flow coolant to outer sides of the cylinders.

Additionally, the first and second passages in each head typically merge upwardly and beyond the intake porting, whereby coolant in the first and second passages merges for removal from the head; the head has an upper wall defining the merging path of one of the coolant streams, and also defining a drain surface for lubricant in the rocker arm chamber; and the air intake manifolding and porting is located between and above the loci of coolant streams merging in the two heads, for isolation purposes.

These and other objects and advantages of the invention, as well as the details of an illustrative embodiment, will be more fully understood from the following specification and drawings, in which:

DRAWING DESCRIPTION

Figure 4:
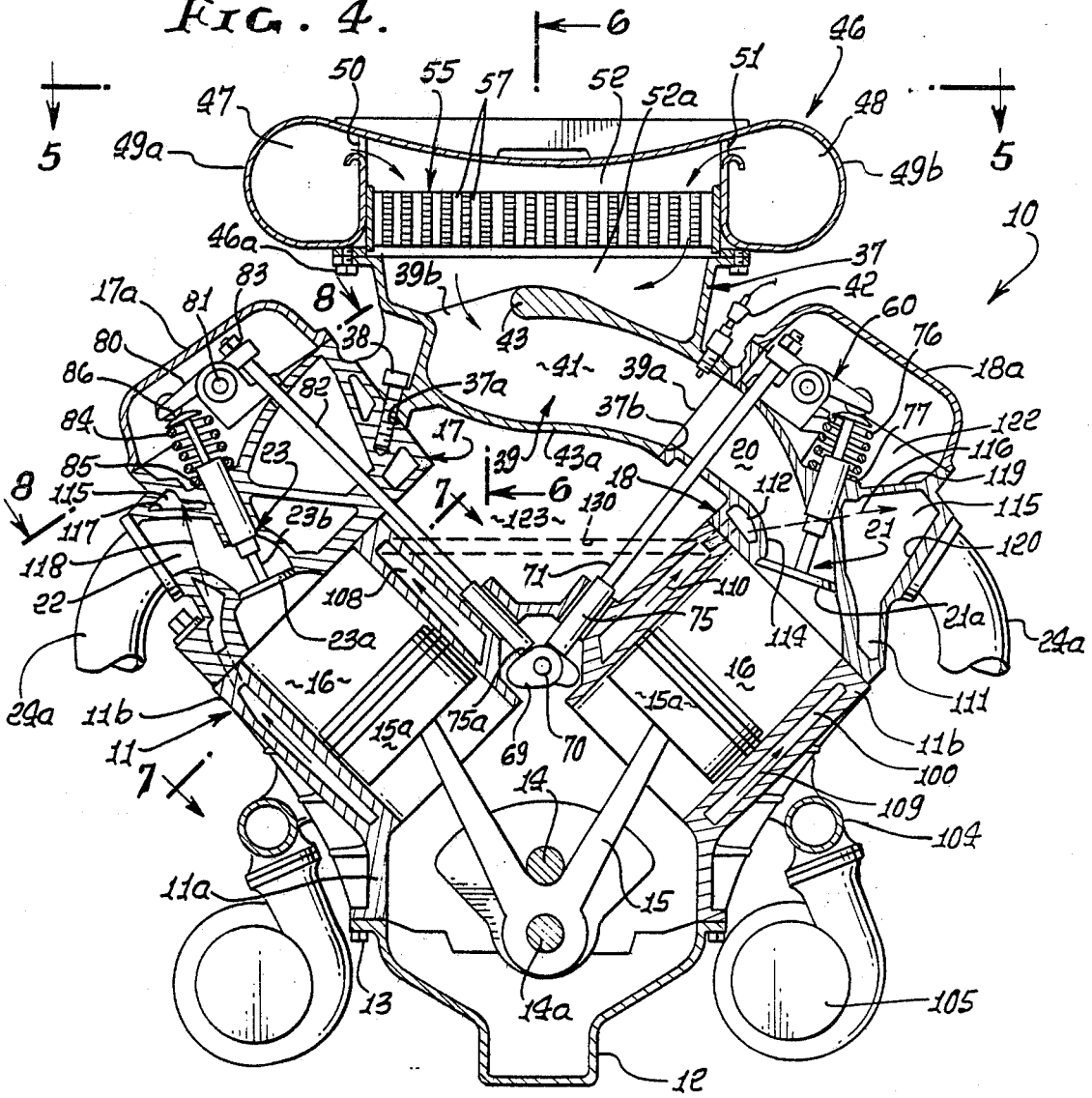
FIG. 4 is a section taken on elevation on lines 4—4 of FIG. 1.
Figure 4A:
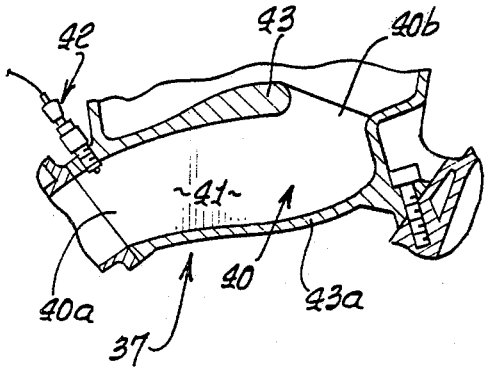
Figure 4B:
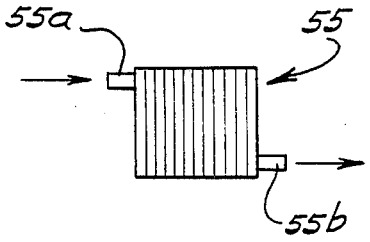
Figure 5:
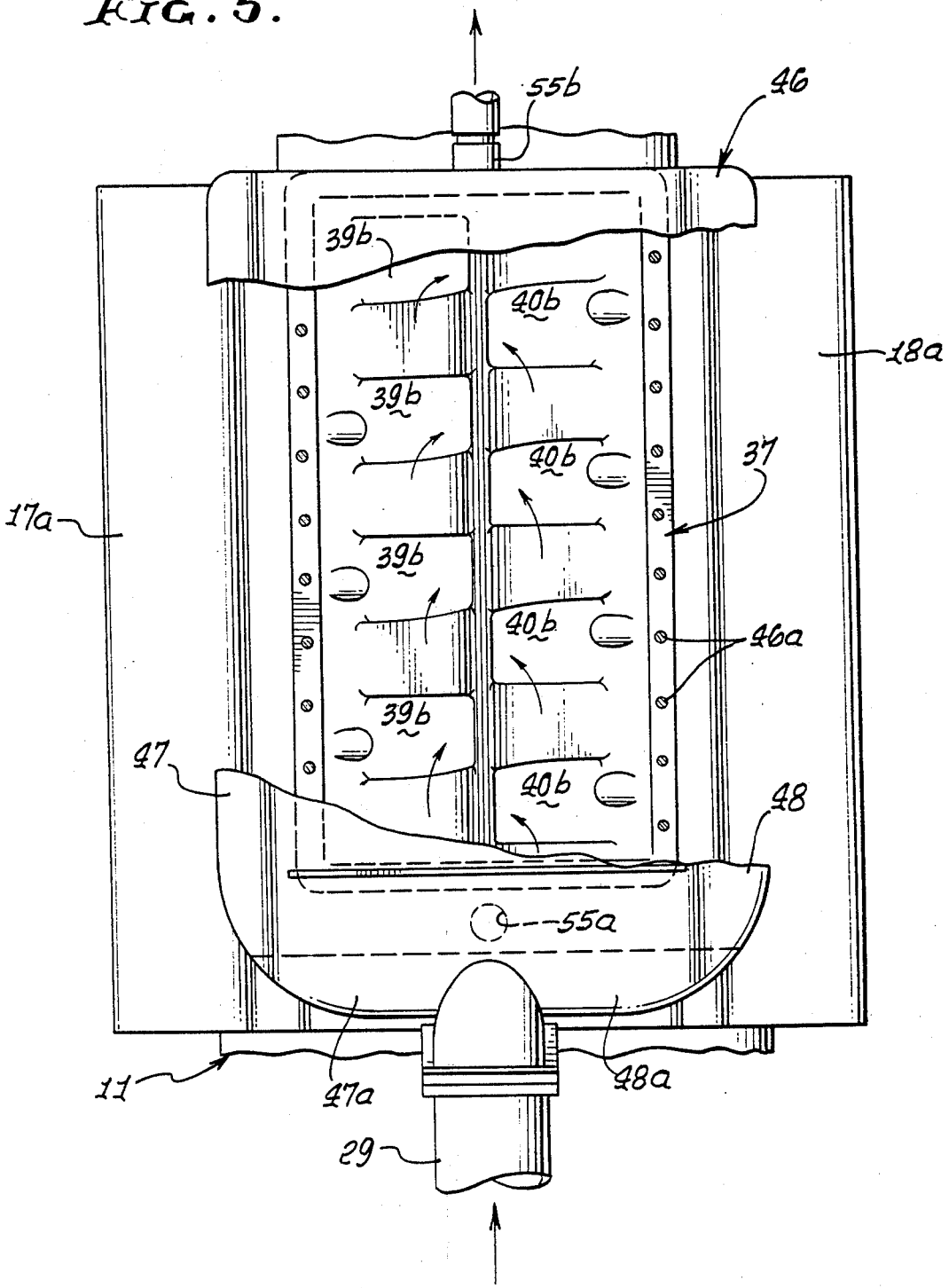
Figure 6:
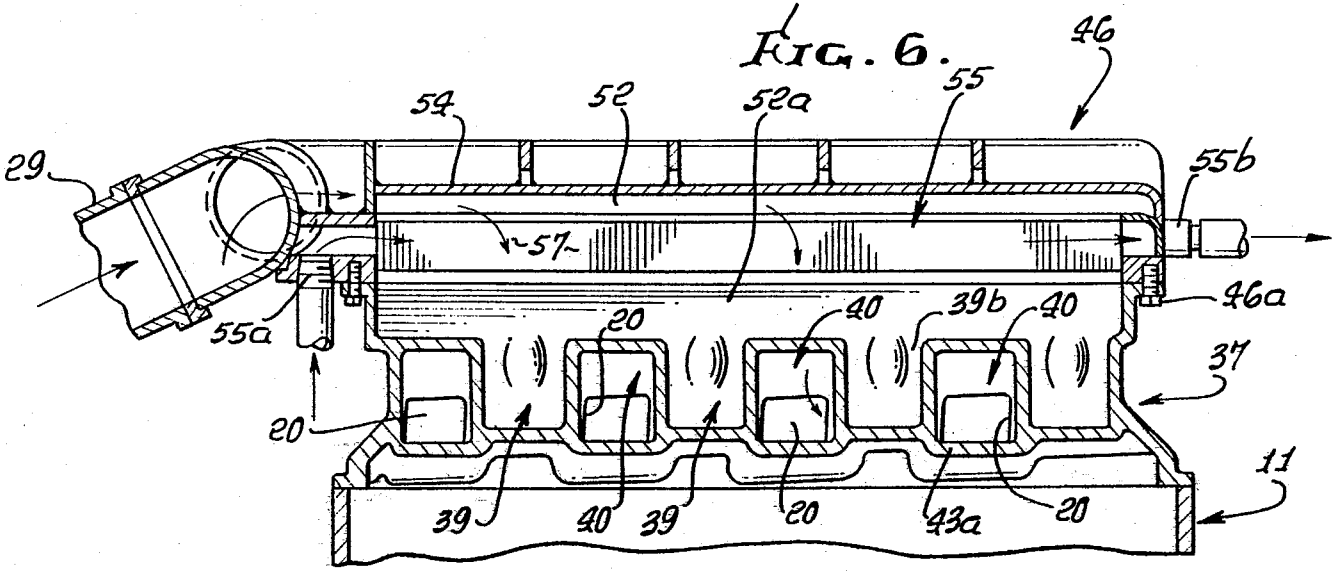
Figure 7:
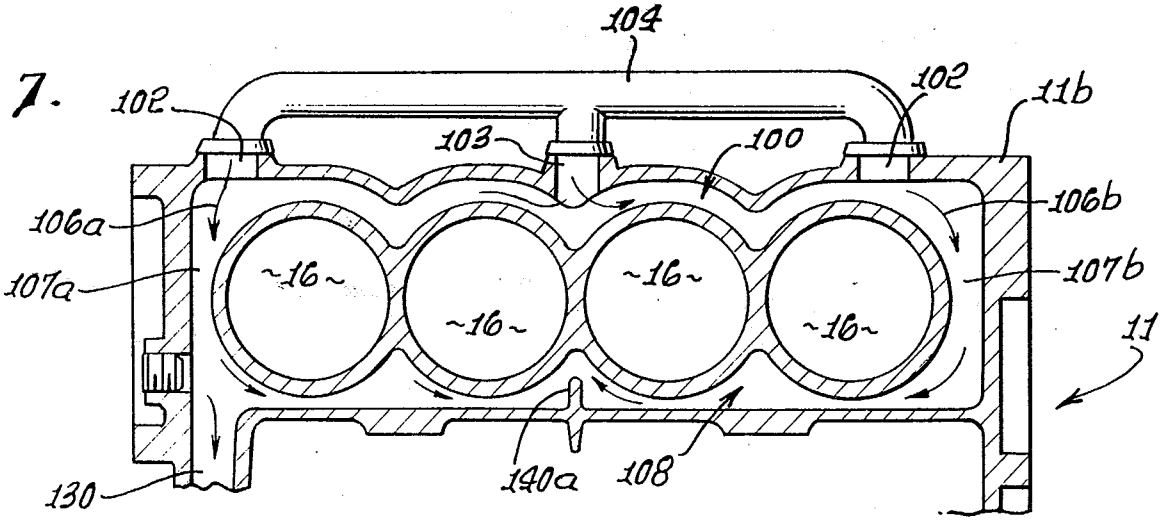
Figures 8, 8A, 8B:
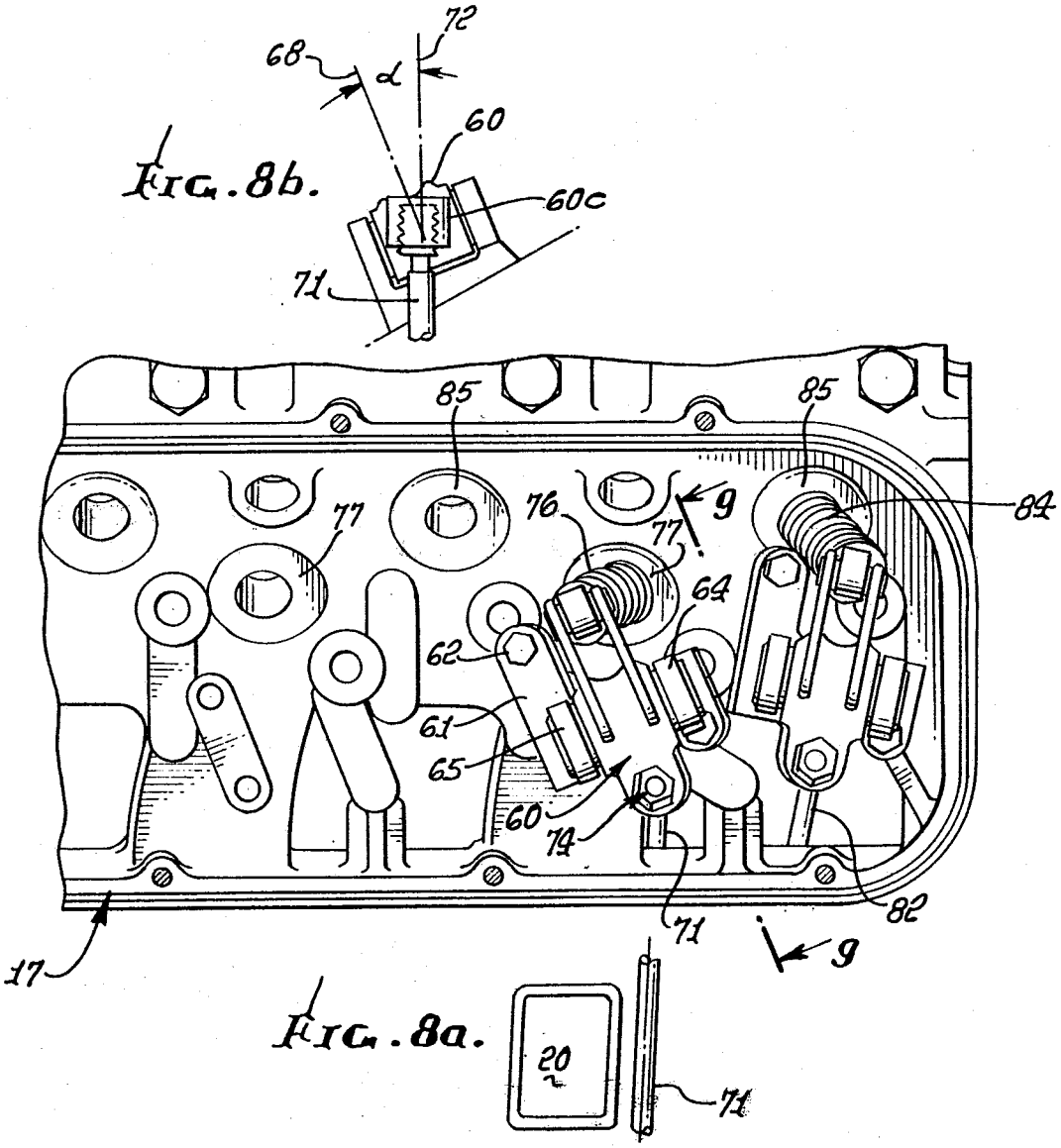

FIG. 4*a* is a fragmentary view of a leftward extending runner duct; and FIG. 4*b* is a plan view of a heat exchanger;

FIG. 5 is a top plan view taken on lines 5—5 of FIG. 4, and partly broken away to show interior construction;

FIG. 6 is a section taken on lines 6—6 of FIG. 4;

FIG. 7 is a section taken on lines 7—7 of FIG. 4;

FIG. 8 is an enlarged view taken on lines 8—8 of FIG. 4;

FIG. 8*a* is an enlarged view showing a push rod related to an intake valve port.

FIG. 8*b* is an enlarged view showing a rocker arm and push rod relationship.

Figure 9:
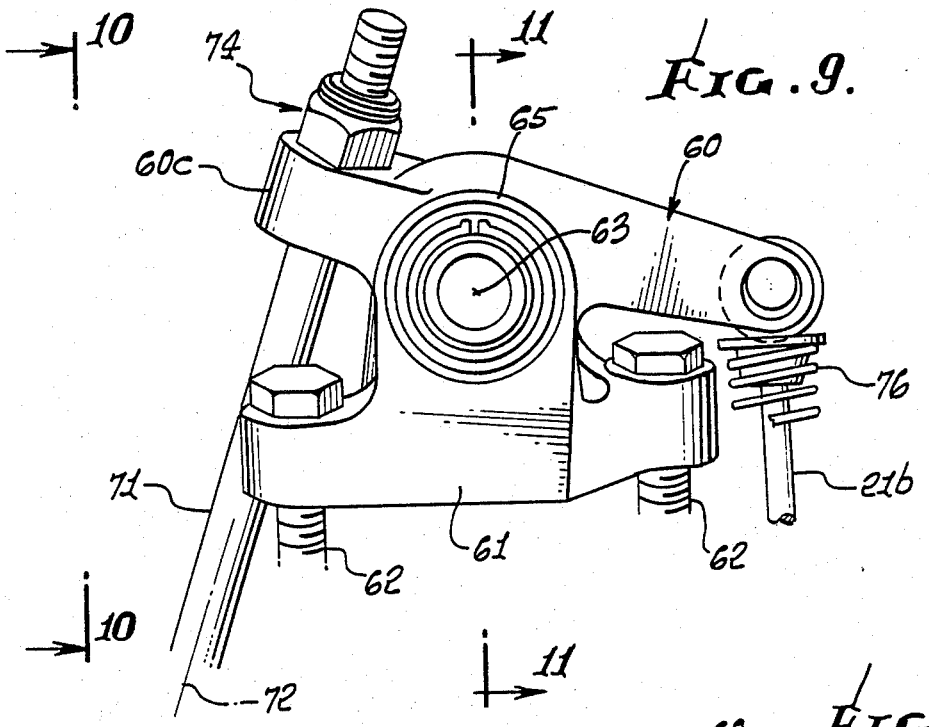
Figure 10:
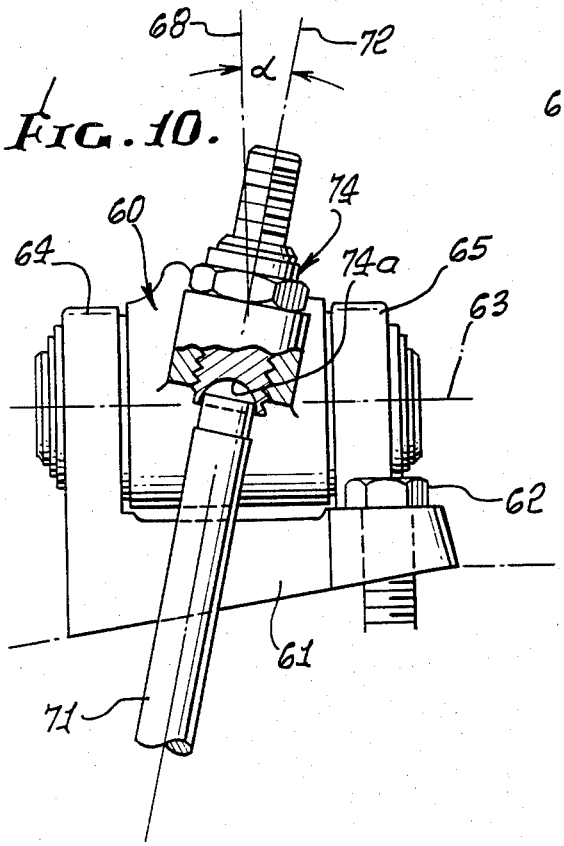

FIG. 9 is a further enlarged section taken on lines 9—9 of FIG. 8;

FIG. 10 is an elevation taken on lines 10—10 of FIG. 9; and

Figure 11:
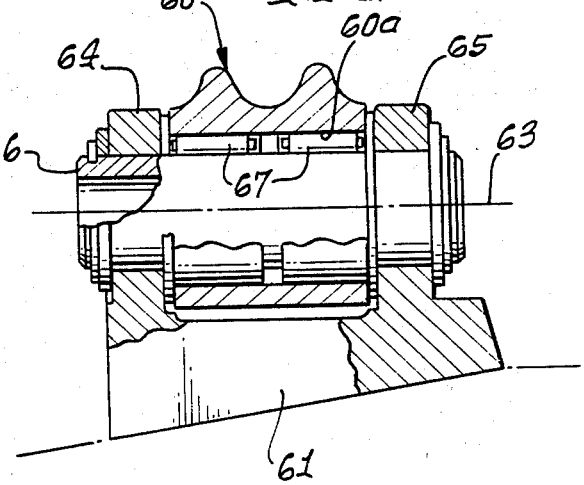

FIG. 11 is a section taken on lines 11—11 of FIG. 9.

GENERAL DESCRIPTION

In FIGS. 1-4 the internal combustion engine 10 includes a block 11 which is generally Y-shaped in vertical section, as seen in FIG. 4. Crankcase pan 12 is connected at 13 to the downwardly extending crankcase section 11*a* of the block, that section containing the crankshaft 14 having throws 14*a*, and connected with pistons 15*a* via rods 15. The pistons are arranged in two parallel banks, at V-shaped angles, to reciprocate within cylinders 16 defined by the block V-sections 11*b*. Cylinder heads 17 and 18 are attached at 17*b* to the block sections 11*b*, and head covers 17*a* and 18*a* are mounted to the heads, as shown. The block may advantageously comprise cast aluminum silicon alloy as disclosed in U.S. Pat. No. Re. 27,081, providing an over all lightweight construction suitable for aircraft, for example.

The cylinder heads define air/fuel mixture intake ports 20 which are controlled by intake valves 21 having heads 21*a* and extending in two parallel longitudinal rows; and the cylinder heads also define exhaust outlet ports 22 controlled by valves 23 having heads 23*a* and extending in two parallel longitudinal rows.

Exhaust manifolds 24 include feeder ducts 24*a* connected to the cylinder heads to receive exhaust gases from ports 22, and main ducts 25 connected with the feeder ducts and extending generally longitudinally to deliver hot, high velocity exhaust gases to turbines 26 having discharge outlets at 27. The turbines drive compressors 28 which in turn compress intake air for delivery via duct 29 to the air intake system. An air flow meter appears at 29*a*.

Figure 1:
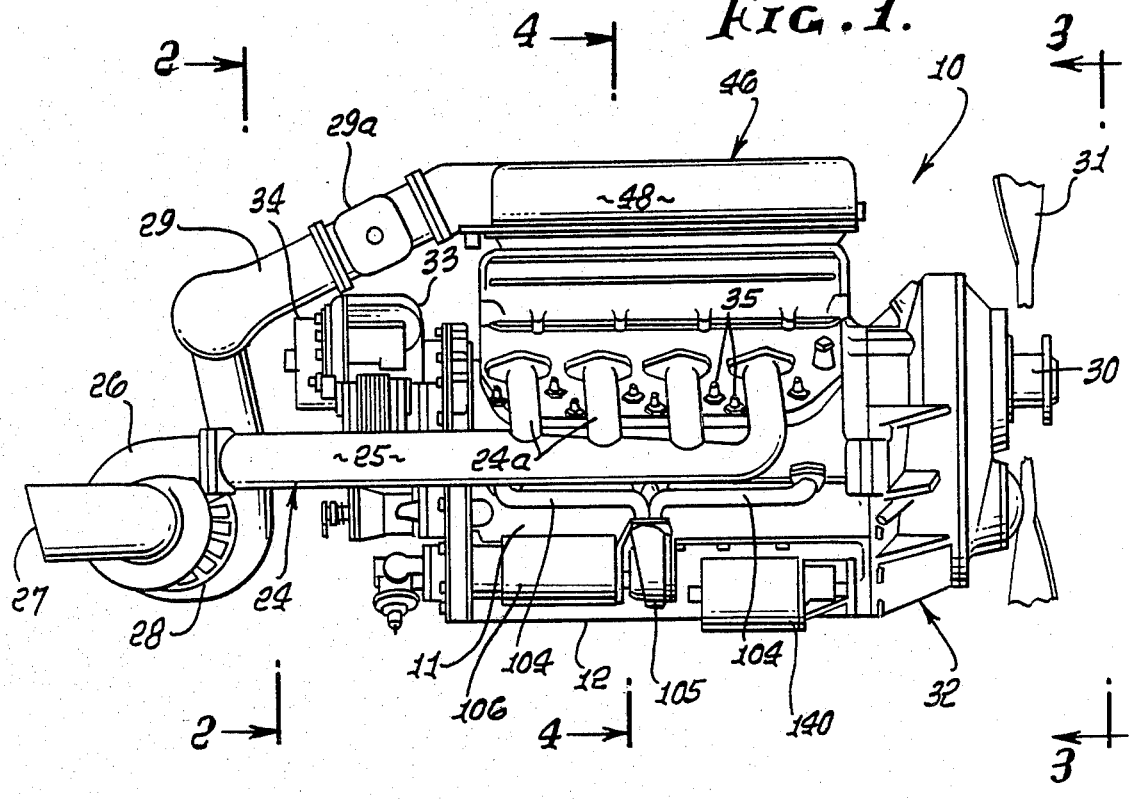
FIG. 1 is a side elevation of an engine incorporating the invention.

As seen in FIG. 1, an output shaft 30 carries a propeller 31, the shaft 30 being driven via speed reducing gearing in transmission housing 32. That gearing couples the crankshaft 14 to shaft 30. Magnetos 33 and alternator 34 provide properly timed ignition voltage pulses to spark plugs 35, two for each cylinder.

AIR/FUEL SUPPLY SYSTEM

Referring to FIGS. 4 and 5, the engine has air intake manifolding 37 proximate the two parallel cylinder heads 17 and 18. That manifolding may advantageously comprise a single metallic body, cast from aluminum or magnesium. The manifold block is shown in FIG. 4 as having its opposite lower sides 37*a* and 37*b* extending in V-shaped planes and nested between and connected to the two heads 17 and 18, as via connectors 38.

The manifolding 37 includes integral runner ducts 39 and 40 that extend generally laterally and in generally parallel relation, with adjacent ducts, (except the longitudinally opposite end ducts) separated by a common wall 41. Ducts 39 extend rightwardly toward discharge ends 39*a* communicating with intake valve ports 20 associated with head 18; and ducts 40 extend leftwardly toward discharge ends 40*a* communicating with intake valve ports 20 associated with head 17 (see FIG. 4*a*). Each runner duct has an intake end spaced generally laterally from its discharge end, and the intake ends 39*b* extend in a longitudinal row spaced laterally from the longitudinally extending row of intake ends 40*b*. All intake ends open upwardly, as shown. This arrangement of runner ducts and common walls between the ducts achieves reduced weight, compactness, and uniform high volume and mass flow patterns of cooled compressed air into the intake valve porting in the heads, with uniform temperature distribution in each set of ducts at loci in longitudinal planes. Note the fuel injectors 42 located to inject fuel into the high velocity air streams at the discharge ends 39*a* and 40*a*. Note also the upper walls 43 of the ducts extending from the mid-portion of the plenum chamber toward the discharge ends of the ducts, whereby the inlet ends 39*b* of ducts 39 are closer to head 17 than to head 18, and the inlet ends 40*b* of ducts 40 are closer to head 18 than to head 17. Ducts 39 extend in alternating relation with ducts 40, in the longitudinal direction, one duct for each port 20. Bottom walls 43*a* extend across the space between heads 17 and 18.

Also provided is a plenum chamber 46 in open and direct communication with the intake ends 39*b* and 40*b*, and via which high volume, high pressure air is supplied to both sets or rows of runner ducts 39 and 40, via upwardly opening ports 39*b* and 40*b*, for high efficiency. Bolts 46*a* attach the plenum to body 37.

As shown, chamber 46 has two longitudinally extending laterally spaced header zones or ducts 47 and 48 connected as via duct 29 and laterally extending branch ducts 47*a* and 48*a* to receive delivery of pressurized intake air. The ducts or zones 46 and 47 have arcuate, and generally circular cross sections formed by generally circular walls 49*a* and 49*b*, to direct air flow laterally via elongated side openings 50 and 51 toward the upper interior 52 of the plenum chamber. That chamber has an upper wall 54 which is downwardly convex so as extend downwardly and laterally toward the uppermost mid-portion of the chamber, thereby to deflect the entering air downwardly toward the upwardly opening intake ends 39*b* and 40*b* of the runner ducts.

Air cooling means is provided in the plenum chamber in the path of entering air flowing downwardly. Such means typically comprises a heat exchanger as at 55, that extends longitudinally and laterally horizontally between upper open interior 52 and lower open interior 52*a* of the chamber 46, and having vertical ports 57 to pass the air freely downwardly but in contact with the thin exchanger walls that form passages flowing coolant fluid. FIG. 4*b* shows coolant fluid entering the exchanger 55 via inlet port 55*a* and leaving via outlet port 55*b*. Accordingly, the high pressure entering air is cooled to increase its density just prior to entering the elongated ducts 39 and 40, for increasing engine horsepower.

VALVE ACTUATION

Referring to FIGS. 4 and 8–11, a rocker arm 60 is associated with each intake valve 21, and is carried by the associated head 17 or 18. Rocker arm support 61 is bolted at 62 to the head, and the arm defines a pivot axis 63. FIG. 11 shows support 61 as having bifurcations 64 and 65 receiving a tubular bearing pin 66. Needle bearings 67 are located between pin 66 and the rocker arm bore 60*a*.

Each valve 21 includes a stem 21*b* extending in a first plane 68 normal to pivot axis 63 (see FIGS. 8 and 10). Engine driven cams 69 on cam shaft 70 activate push rods 71 respectively associated with the rocker arms. Each push rod is reciprocable along axis 72 that extends at a skew angle $\alpha$ (in FIG. 10) relative to plane 68, so that each push rod extends outside the intake valve porting associated with that intake valve. Thus, the push rods pass through the head between and outside intake valve ports 20 extending in a longitudinal row in that head. FIGS. 9 and 10 show the rocker arm as having a skewed or twisted end portion 60*c* to provide a threaded connection at 74 in alignment with axis 72 and via which the push rod actuates the rocker arm. A seat for the end of the rocker arm is shown at 74*a* in FIG. 10. The axis of that seat is in alignment with axis 72. The lifter 75 at the opposite end of the push rod engages a cam as at 75*a* in FIG. 4. A compression spring 76, seated at 77, urges the rocker arm counterclockwise in FIGS. 4 and 9, in a valve head seating direction. Each plane 68 intersects a port 20 and a runner duct 39 or 40, as the case may be.

FIG. 4 also shows exhaust valve rocker arms 80, pivoted at 81, and having push rods 82 connected with the arms at 83. Compression springs 84, seated at 85, urge the arms in a clockwise, valve seating direction. Valve stems 23*b* are connected with the arms at 86.

COOLING SYSTEM

Referring now to FIGS. 4 and 7, the cylinder block sections 11*b* (which may be separate from crankcase section 11*a* and attached thereto) form coolant passages proximate the cylinders. Passages 100 are formed at one side of the cylinders, and passages 108 are formed at the opposite sides of the cylinders. Multiple coolant fluid (water for example) inlets are located to intersect passages 100 near the longitudinally opposite ends of passages 100, and at the middle of each elongated passage. See inlets 102 and 103. Coolant inlet manifold 104 communicates with those inlets, and coolant fluid pumps are provided at 105, as seen in FIG. 1.

The coolant from inlet 103 is thereby caused to flow endwise and upwardly in the elongated passage 100 adjacent the outer sides of the cylinders 16; also, the coolant from inlets 102 flows in passages 107*a* and 107*b* around opposite ends of the row of cylinders, two streams being shown at 106*a* and 106*b*, to supply coolant to passages 108 along the opposite, and inner sides of the cylinders. Thus, the coolant supplied to passages 108 is not heated by first flowing in passages 100.

The coolant in passages 100 and 108 flows generally upwardly, as indicated by arrows 109 and 110, respectively, in FIG. 4, under pressurization and also due to convection, the fluid being progressively heated.

Each head 17 and 18 has first and second coolant passages 111 and 112 respectively in communication with cylinder block passages 100 and 108, to receive upward flow of coolant. The second passages 112 extend proximate the air/fuel intake porting 20, to flow coolant upwardly past walls 114 defining that porting and to an upper zone 115 in the head, as indicated by arrow 116. The first passages 111 extend proximate the exhaust porting 22, to flow coolant upwardly pass walls 117 defining that porting and to upper zone 115 in the head, as indicated by arrow 118.

Figure 3:
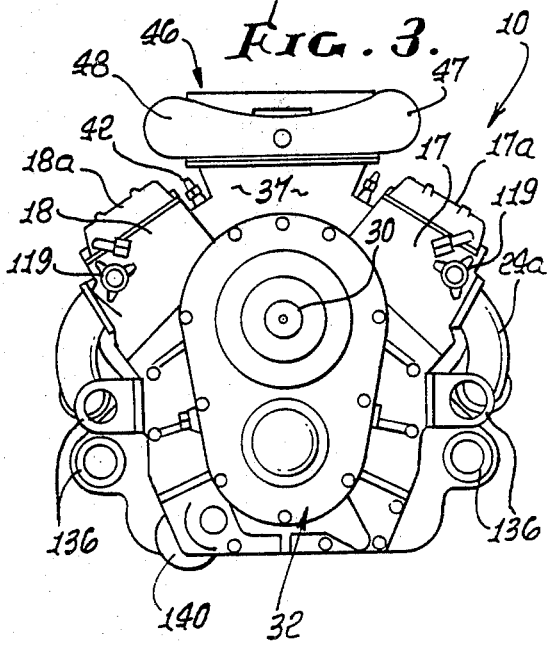
FIG. 3 is an end elevation taken on lines 3—3 of FIG. 1.

Accordingly, the two flow streams 116 and 118 merge in the upper zone 115 in each head, and are withdrawn from the ends of the heads as via ducts 119, shown in FIG. 3. Therefore, it is seen that the hotter stream of coolant 118 does not pass adjacent the air/fuel mixture intake porting 20, or adjacent the intake runner ducts 39 and 40, which generally extend at a higher level than the passages 111 and 112. Consequently, the incoming air/fuel mixture is not warmed by heat from the warmer or hotter coolant flow at 118.

Note that upper walls 119 and 120 of each head taper upwardly, to merge the two flows 111 and 112 toward uppermost zone 115, for endwise flow and exit from the head. Finally, the upper wall 119 is inclined laterally inwardly and downwardly, to drain lubricant in space 122 toward the interior space 123. Rocker arms 60 and associated mechanism are lubricated in space 123 and lubricant flowing toward interior space 123, below the air/fuel mixture manifolding, for draining. Accordingly, walls 119 serve multiple functions.

FIG. 7 also shows a barrier 140*a* at the middle of passage 108 to partially block endwise flow of coolant therein and deflect coolant to flow upwardly. Accordingly, approximately balanced heating of the coolant takes place in the passages 100 and 108 (i.e. there are two streams of coolant respectively in opposite portions of passage 100, and two streams of coolant respectively in opposite portions of passage 108).

Figure 2:
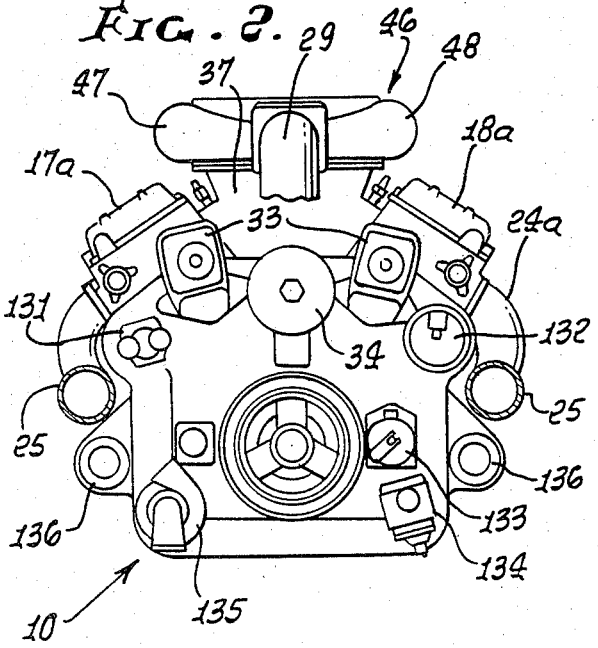
FIG. 2 is an end elevation taken on lines 2—2 of FIG. 1.

To complete the description of the engine, a starter is shown at 140 in FIG. 1; hydraulic and vacuum pumps appear at 131 and 132 in FIG. 2; a propeller pitch control is indicated at 133 and a fuel pump at 134, a pump for the intercooler 55 appears at 135, and engine mounts are provided at 136. An oil pump appears at 106.

The duct 130 shown in FIGS. 4 and 7 interconnects the coolant passages 108 in the two block sections 11*b*, duct 130 also being in the block. Thus, if one of the two coolant pumps 105 fails for any reason, the other coolant pump can supply coolant to the coolant passages in both block sections 11*b*.

I claim:

1. In an internal combustion engine having air/fuel intake manifolding and porting proximate the head of the engine, and exhaust manifolding and porting proximate the head of the engine, the improvement comprising (a) a cylinder block having two longitudinal rows of cylinders with V-shaped configuration, (b) the block forming coolant passages proximate the cylinders of each row, there being three coolant inlets at the outer side of each of said cylinder rows to flow coolant to said passages at said one side of each of said rows and also to flow coolant around opposite ends of each row to the passages at the other side of said row, two of the inlets located proximate opposite ends of the associated row to flow unheated coolant around opposite ends of the cylinder row and to the passages at the innerside of the row, and the third inlet located generally midway between said opposite ends of the associated row to flow unheated coolant to the passages at the outer side of the row, (c) and a cylinder head for each of said rows of cylinders, each head having first and second coolant passages respectively in communication with said passages in the block at said one and said other side of each said row of cylinders to receive coolant flow therefrom, said second passages in the head extending proximate the air/fuel intake porting, said first passages in the head extending proximate the exhaust porting, said intake manifolding everywhere isolated from said first passages in the head, (d) said first and second passages merging in an upward direction and beyond said intake porting, whereby the coolant in said first and second passages merges for removal from the head.

2. The improvement of claim 1 wherein each head has an upper wall angled to drain lubricant laterally toward the region between said two rows of cylinders.

3. The improvement of claim 1 including a barrier in the path of the coolant flowing in passages at said other side of each row of cylinders, for deflecting the flow generally upwardly toward the head associated with that row.

4. The improvement of claim 1 wherein each head has wall structure forming an upwardly tapering zone to merge said flow from said first and second passages in the head.

5. The improvement of claim 4 including a fluid outlet duct communicating with said zone.

6. The improvement of claim 1 wherein said air intake manifolding is located generally between said heads and closer to said second passages than to said first passages.

7. The improvement of claim 6 wherein said air intake manifolding includes runner ducts that extend laterally and in generally parallel relation, above the levels of said passages.

8. The improvement of claim 1 including an interconnect coolant passage extending between the coolant passages associated with the two rows of cylinders.

9. The improvement of claim 8 including two coolant pumps, one pump connected with the coolant passage inlets associated with one row of cylinders, and the other pump connected with the coolant passage inlets associated with the other row of cylinders.

* * * * *